United States Patent [19]

Knutsen

[11] 4,426,949

[45] Jan. 24, 1984

[54] METHOD FOR MAKING ELONGATE CAST CONSTRUCTION ON THE SEA

[76] Inventor: Einar Knutsen, Astrupsvei 36, 5032 Minde, Norway

[21] Appl. No.: 330,764

[22] Filed: Dec. 14, 1981

Related U.S. Application Data

[62] Division of Ser. No. 103,467, Dec. 14, 1979, Pat. No. 4,327,656.

[51] Int. Cl.[3] ..... B63C 1/02; B63B 5/14

[52] U.S. Cl. ..... 114/47; 14/27; 114/65 A; 114/77 R; 264/33; 425/63

[58] Field of Search ..... 114/65 R, 65 A, 47, 114/45, 77 R; 405/4, 6, 222; 264/31, 33; 425/63; 14/1, 27; 249/20–22

[56] References Cited

U.S. PATENT DOCUMENTS 1,299,729 4/1919 Hubbell ..... 425/61

4,228,114 10/1980 Alsen et al. ..... 264/33

*Primary Examiner*—Sherman D. Basinger

*Attorney, Agent, or Firm*—McCormick, Paulding & Huber

[57] ABSTRACT

Floating dock for making elongate, cast concrete constructions by producing in sequence sections of the construction in a drainable work chamber. The dock has a base and a pair of permanent upstanding sides facing inwardly towards each other provided with a first set of fixed fastening members for locating anchoring members for the fastening of boarding members with associated reinforcing elements in a first position in the dock where a first section of the construction is cast. A second set of fixed fastening members in series with the first set is for fastening by way of corresponding anchoring members at least portions of the first section in a second position in the dock where a second section of the construction is moulded as a continuation of the first section.

4 Claims, 2 Drawing Figures

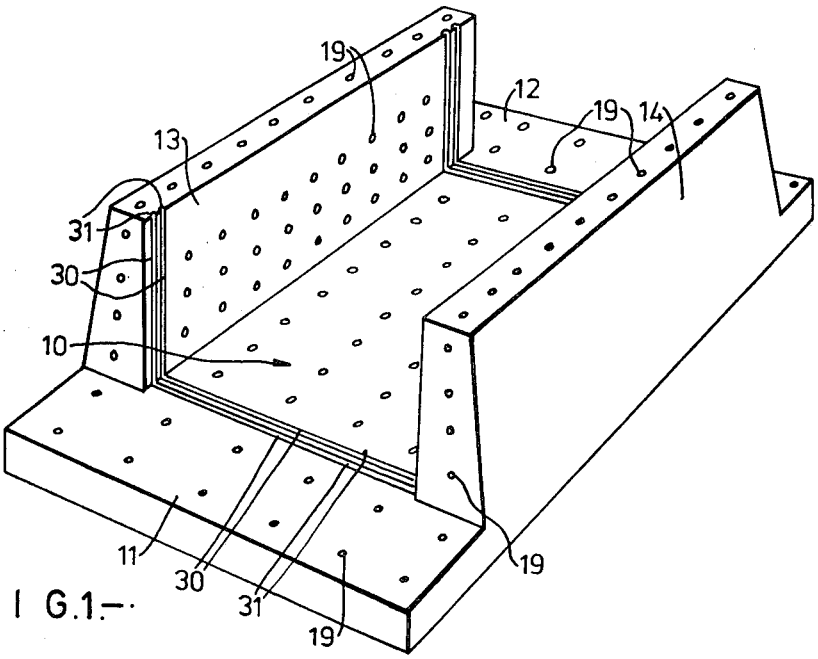
-FIG.1-
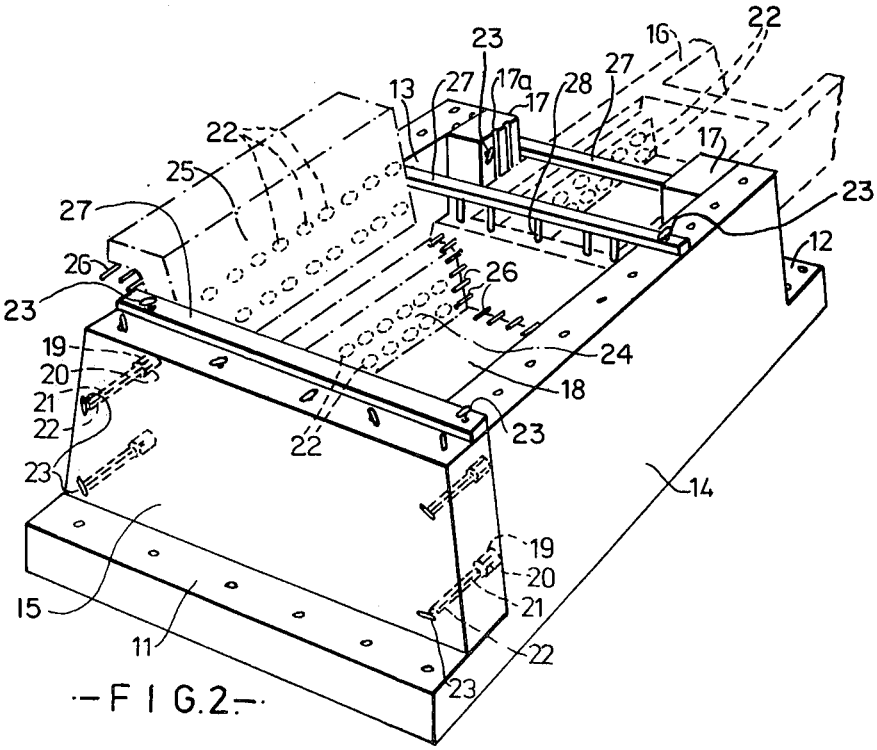
-FIG.2-

METHOD FOR MAKING ELONGATE CAST CONSTRUCTION ON THE SEA

This is a division of application Ser. No. 103,467 filed Dec. 14, 1979 now U.S. Pat. No. 4,327,656.

BACKGROUND OF THE INVENTION

This invention relates to floating docks for making elongate, cast concrete constructions.

With the present invention the aim is to provide a floating dock which can be applied in the production of a floating bridge or similar elongate constructions directly on the sea. The floating dock can be applied for the separate production of construction sections directly in the dock in a work chamber defined within two opposing end gates in the dock or for the production of a construction section as a direct continuation of a preceding construction section in a corresponding manner as in moving forms, in a work chamber defined within an end gate at one end of the dock and an adjoining end of the preceding construction section at the opposite end of the dock. The floating dock can also be applied for joining together opposing ends of separately produced construction sections or opposing ends of separately produced, elongate constructions, the sections or the constructions individually (if desired together with extra cut-off means) forming end limitations of the work chamber in the floating dock.

In the manufacture of such elongate constructions directly on the sea, the construction is subjected to movements in step with the sea's movements and, at times, quite strong movements. During the manufacturing process, and especially during casting and hardening of the newly moulded section of the construction, it is of great significance that undesired movements can be avoided in the joint between the finished construction(s) and the construction section which is made in the floating dock and that undesired movements can be avoided between floating dock and the construction section which is made in the floating dock.

It is usual that substantial parts of the boarding or formwork support the cast construction section, at any rate, some days after moulding until the construction section has become suitably hardened and has attained sufficient self-rigidity and strength. In order to obtain a modern rational manufacture, it is of importance that the floating dock or, at any rate, certain of the boarding or formwork members can be made ready for the next moulding operation while the hardening out itself of the moulded construction is effected. In order be able to effect such a preparation of the boarding members of the floating dock and the like, it is of importance that the connection between the floating dock and the cast construction is sufficiently shored up and exhibits the necessary strength to withstand the sea's movements without straining the construction section which is being hardened.

Accordingly, the present invention resides in a floating dock for manufacturing an elongate, cast concrete construction by producing sequentially in its drainable work chamber sections of said construction, said dock having upwardly and inwardly facing panels provided with a first set of stationarily arranged fastening members for locating anchoring means for fastening board members having associated reinforcing means in a first position in said dock for the casting of a first section of said construction and a second set of stationarily arranged fastening members in series with said first set for fastening via corresponding anchoring means at least portions of said first section in a second position in said dock for moulding on a second portion of said construction as a continuation of said first section.

By providing a non-displaceable and mutually shored up, local fastening of the floating dock and the associated end portion of the construction section, the movements of the floating dock can be limited largely to the movements of the produced construction. In this way, minimal movements are obtained in the work chamber in which the newly moulded construction section is cast, so that the construction section can be hardened out in precisely the manner intended. By employing readily releaseable fastening means in the connection between floating dock and construction, the fastening and release of the construction can be effected in an easy and reliable manner, and this can be carried out especially easily and reliably by regulating, at the same time, the gripping force between floating dock and construction on trimming ballast tanks of the floating dock. The loading between floating dock and construction can also be adjusted in step with the moulding on of the new section on trimming the ballast tanks.

In order to be able to carry out the manufacture in a rational but, at the same time, accurate and reliable manner, it is of importance that readily detachable fastening means be used. This is of particular importance when the floating dock is to be made ready for a subsequent moulding operation while the hardening of the recently cast section is effected. In this connection, it is of great importance that certain boarding members are mountable and dismountable in the floating dock independently of the fastening between the floating dock and the construction. In this way, certain parts of the boarding can be dismounted while the hardening is in progress and, in addition, reinforcement and like can be added to such dismounted boarding members so that the latter are made ready for new mounting after the cast construction section is drawn endways over towards the associated end of the floating dock.

SUMMARY OF THE INVENTION

In accordance with the invention, a method for making an elongate cast construction in a dock floating on the sea and having upwardly and inwardly facing panels defining a work chamber comprises the steps of providing fixed fastener receiving members in said panels, positioning boarding members within said work chamber, assemblying said boarding members with said dock to define a mold cavity by inserting fasteners through said boarding members and engaging said fasteners in associated fastener receiving members, introducing molding material into said mold cavity, removing said fasteners and at least some of said boarding members from assembly with said dock after said molding material has hardened to form a first part of said elongate case construction, removing an end panel from said dock, pushing a portion of said first part outward through the open end of the dock from said work chamber and into the sea, securing said first part to said dock by inserting fasteners through voids in said first part formed by removal of fasteners and engaging the inserted fasteners with associated fastener receiving members, and casting a second part of said elongate construction within said work chamber as a continuation of said first part.

In order that the invention can be more clearly understood, a convenient embodiment thereof will now be described, by way of example, with reference to the accompanying drawings.

BRIEF DESCRIPTION OF THE DRAWINGS

FIG. 1 is a perspective view of a floating dock with the end gates removed for the sake of simplicity, and FIG. 2 is a perspective view of the floating dock of FIG. 1 with an end gate arranged in position at one end of the dock and with a concrete construction arranged in position at the other end of the dock, the concrete construction being shown in broken lines.

DETAILED DESCRIPTION OF PREFERRED METHODS

Referring to FIG. 1, a floating dock is provided with a central base portion 10 and two adjoining base portions 11 and 12 projecting outwardly in an endwise direction together with two side portions 13 and 14 projecting upwardly in a height direction. In the base portions 10–12 and the side portions 13 and 14, there are arranged in a manner known per se locally limited ballast tanks with associated ballast pumps and pump conduits (not shown). The pumps and the pump conduits are arranged so that ballast water can be transferred from certain ballast tanks to remaining ballast or the individual ballast tanks separately emptied and filled as well as enabling the transfer of water from ballast tanks to the working space, which is defined centrally in the floating dock, and back again from this working space to the ballast tanks. In this manner, the floating dock can be trimmed in various ways, as required, with the aid of the ballast water.

In FIG. 2, the floating dock is shown after one end of the dock is closed with an end gate 15, and its opposite end is closed with a concrete construction 16 illustrated in broken lines and a surrounding closing arrangement. Between the end gate 15 and the concrete construction 16 and the associated closing arrangement 17, there is defined, in the floating dock, a work chamber 18 which can be drained as needed with the aid of the afore-mentioned ballast pumps and associated pump conduits.

In the bottom portions and side portions of the floating dock, there are arranged rows of fastening sockets 19 with internal threads for the reception of corresponding screw pins 20 at the one end of rod-shaped fastening means 21. The fastening means 21 pass through sleeve-shaped guides 22 in the end gate 15 and the closing arrangement 17 and are provided at the outwardly extending end with a wheel or other actuating means 23. The fastening sockets 19 are also designed for the reception of corresponding fastening means for securing separately handleable, external and internal boarding members 24, 25 (shown in chain lines in FIG. 2) with associated reinforcing equipment 26 (fastened to the internal boarding members 25) for the construction section which is to be cast in the work chamber 18 as a continuation of the concrete construction 16. In addition, the fastening sockets 19 can be utilized for securing the concrete construction 16 to the floating dock since during the moulding of the concrete construction, there can be cast into the latter sleeve-shaped guides corresponding to the guides 22 in the end gate and the closing arrangement. There are also employed fastening sockets 19 on the top of the side portions 13–14 of the floating dock for securing transoms 27. In the transoms 27, there are suspended, via height regulatable tension means 28, for example, pressure medium cylinders, the internal boarding members 25 with the reinforcing equipment 26 of the construction readily and detachably fastened to these.

From FIG. 1, it is evident that there are arranged sealing means known per se in the form of inflatable rubber tubes 30 in each of the parallel extending grooves 31 at edge areas of the bottom portion 10 and the side portions 13, 14 in order to form a seal between the floating dock and its end gate 15 and closing arrangement 17. Similarly, rubber tubes and grooves are arranged in a cavity 17*a* in the closing arrangement in order to form a seal between the closing arrangement 17 and the concrete construction 16. In an uninflated condition, the rubber tube lies inserted, in a protected manner, at the bottom of the groove 31 while in an inflated condition, it fills out the intermediate space between the floating dock and the end gate or the closing arrangement and between the closing arrangement and the concrete construction.

In the manufacture of an elongate concrete construction 16 which in this embodiment consists of a floating bridge, there is produced initially a first section in the work chamber 18 defined between two opposing end gates 15 of the floating dock, the closing arrangement 17 and the illustrated concrete construction 16 having been replaced by an end gate and an associated end boarding member (not shown).

In the production of the next construction section, the one end gate and associated end boarding member are removed and replaced by the closing arrangement 17 and thereafter the concrete construction produced is pushed, via the cavity 17*a*, outwardly into the ocean to a position which is illustrated in FIG. 2 and held in this position so that the afore-mentioned next construction section can be cast as a direct extension of the section already made.

In the manufacturing operations which follow next, the concrete construction produced is pushed or pressed relatively outwards into the ocean via the cavity 17*a* in the closing arrangement 17, the fastening means between the dock and the construction being released and, thereafter, the construction adjusted in the displaced position, as shown in FIG. 2, in order finally to secure it in the new position. By employing the guides with associated fastening means which are moulded into the construction in the work chamber as locating means (and positioning means) for the construction in the outwardly displaced position arranged on the base portion 12, there is achieved an accurate positioning of the construction relative to the floating dock and simultaneously an extra possibility for effectively fastening the floating dock to the finally produced construction. In addition, the concrete construction can be fastened to the floating dock via transoms 27 with associated tension means 28*a* which are secured at accurately established points on the concrete construction. In this way, there is the possibility of surrounding annularly the finished concrete construction and fastening the floating dock in a collar-like manner to the concrete construction. It is also possible to fasten the concrete construction to the floating dock with the aid of laterally extending tension means or laterally extending fixing means, for example, via fixing sleeves in the concrete construction at locations suitable for this purpose.

After the cast section is ready moulded and, at any rate, partially hardened, there can be removed, after having released the reinforcement of the section from the boarding, portions of the boarding, especially the internal boarding members 25, by raising the latter upwards from the cast section via associated transoms 27. While the section is subjected to the necessary additional hardening, the reinforcing equipment of the next section, the guide members which are to be cast into the next section, and the like, can be fixed into position, at the same time, on the boarding members 25, so that in the next manufacturing operation the section produced can be moved outwardly through the closing arrangement and immediately it is fastened in the new position, the internal boarding members 25 with associated equipment are brought into place and the next casting operation is set in motion.

In the illustrated embodiment, there is shown a concrete construction which only partly fills out the space in the floating dock, there being employed separate external boarding members 24 in the floating dock. Alternatively, inner sides of the floating dock itself can be employed as external boarding surfaces. In instances where concrete constructions are to be made which occupy an especially small part of the breadth of the floating dock, there can be employed, for example, instead of the transoms shown which are fixed to side portions of the floating dock, transoms which are fixed, via fixing means, to the bottom portion of the floating dock. Such transoms which are fixed, via fixing means, to the bottom portion of the floating dock can also be employed in fastening the concrete construction to the bottom portion of the floating dock, endwise outside side portions 13, 14 of the floating dock.

In a case where two floating bridge members are produced separately and these are to be joined together endwise, a floating bridge can be arranged at its respective end of the floating dock and a connecting section moulded on in the work chamber 18 in a manner similar to that described above.

In the illustrated embodiment, a trough-shaped section with tranverse end gables has been employed in the joint between each section. Provision is made for the end gable to be moulded on so that each section is separately floatable. If desired, each section can be provided with further transverse or longitudinal dividing walls between the end gables. The guide sleeves which are cast into the section are preferably moulded into the end gables and/or into the dividing walls and/or the side walls, since the guide sleeves can be secured (welded) directly connected to the reinforcing material for the section.

If desired, through-passing guide-forming pipes can be moulded into or secured in another way to the construction for the reception of fastening bolts which can be fixed in the bottom and/or sides of the dock.

In the above described construction, there are disclosed moulded constructions but it is apparent that the floating dock can also be used for the production of elongate constructions of members of steel, aluminium or the like, welded or joined together in another manner.

In the illustrated embodiment, there is shown a closing arrangement with a special design corresponding to the cross-sectional form of the construction produced. It is obviously possible to change the design of the closing arrangement, as required, as required, for adapting to the actual, deviating cross-sectional shapes on the construction produced or to locally fitted construction parts of the produced construction, for example to separate float sections which are locally secured to the construction. The illustrated closing arrangement is thus shown as a pure embodiment in a specific situation.

The floating dock is made up, in the usual manner, of separate float tanks which can be filled and emptied as required for adjusting the floating dock to a desired level in the sea and for exerting a desired upwardly directed lifting force on local parts of the construction. The capacity of the combined number of float tanks is preferably adjusted so that, at any rate, the amount of water which is to be pumped out of the floating dock finds space in the float tanks while considerable buoyancy of the floating dock is, nevertheless, achieved. In this way, the floating dock can be adjusted to a specific level with a favourable upwardly directed pressure loading against the construction in the drained, as well as in the water-filled, condition of the work chamber. In other words, the ballast water can be transferred, as required, from the float tanks to the work chamber, and vice versa, while the desired pressure loading against the construction is maintained. It is preferred that adjustable level-breakers be employed in each float tank and the construction itself so that the height level of the floating dock can be regulated automatically and as required.

I claim:

1. A method for making an elongate cast construction in a dock floating on the sea and having upwardly and inwardly facing panels defining a work chamber and comprising the steps of providing fixed fastener receiving members in said panels, positioning boarding members within said work chamber, assemblying said boarding members with said dock to define a mold cavity by inserting fasteners through said boarding members and engaging said fasteners in associated fastener receiving members, introducing molding material into said mold cavity, removing said fasteners and at least some of said boarding members from assembly with said dock after said molding material has hardened to form a first part of said elongate cast construction, removing an end panel from said dock, pushing a portion of said first part outward through the open end of the dock from said work chamber and into the sea, securing said first part to said dock by inserting fasteners through voids in said first part formed by removal of fasteners and engaging the inserted fasteners with associated fastener receiving members, and casting a second part of said elongate construction within said work chamber as a continuation of said first part.

2. A method for making an elongate cast construction as set forth in claim 1 wherein the step of positioning boarding members is further characterized as positioning inboard and outboard boarding members within said work chamber.

3. A method for making an elongate cast construction as set forth in claim 2 wherein the step of removing at least some of said boarding members is further characterized as removing at least said inboard boarding members.

4. A method for making an elongate cast construction as set forth in any one of claims 1 through 3 including the additional step of positioning a guide sleeve on each of said fasteners and the step of removing said fasteners is further characterized as removing said fasteners from the guide sleeves leaving said guide sleeves in said first part.

* * * * *